United States Patent [19]

Fenrich et al.

[11] 4,375,133

[45] Mar. 1, 1983

[54] JOGGER'S IDENTIFICATION TAG

[76] Inventors: Eileen W. Fenrich, 8409 Fenwood Dr.; Elizabeth S. Garcia, 7031 Flax St., both of Springfield, Va. 22152

[21] Appl. No.: 247,549

[22] Filed: Mar. 25, 1981

[51] Int. Cl.[3] ..... G09F 21/02

[52] U.S. Cl. ..... 40/586; 40/159; 40/10 B

[58] Field of Search ..... 40/1.5, 10, 10 A, 10 B, 40/586, 159; 2/247, 250

[56] References Cited

U.S. PATENT DOCUMENTS

| | | | |
|---|---|---|---|
| 1,255,481 | 2/1918 | Spranger | 2/247 |
| 1,895,704 | 1/1933 | Crosby | 40/10 B |
| 2,821,035 | 1/1958 | Joseph | 40/586 |
| 3,193,842 | 7/1965 | Bell | 2/250 |
| 3,214,852 | 11/1965 | Ford et al. | 40/586 |
| 3,611,444 | 10/1971 | Rector | 2/247 |
| 3,662,480 | 5/1972 | Gilson et al. | 40/586 |
| 4,121,360 | 10/1978 | Vlerebome | 40/586 |

*Primary Examiner*—Gene Mancene
*Assistant Examiner*—Wenceslao J. Contreras
*Attorney, Agent, or Firm*—Cushman, Darby & Cushman

[57] ABSTRACT

An identification tag for attachment to clothing during athletic activities with an elongated cloth pouch which receives therein an insert through an opening at one end. The insert contains medical, identity or other information. The tag is removably attached to the clothing at any desired location by pins extending through the cloth pouch and clothing at respective ends of the pouch.

3 Claims, 3 Drawing Figures

FIG. 1
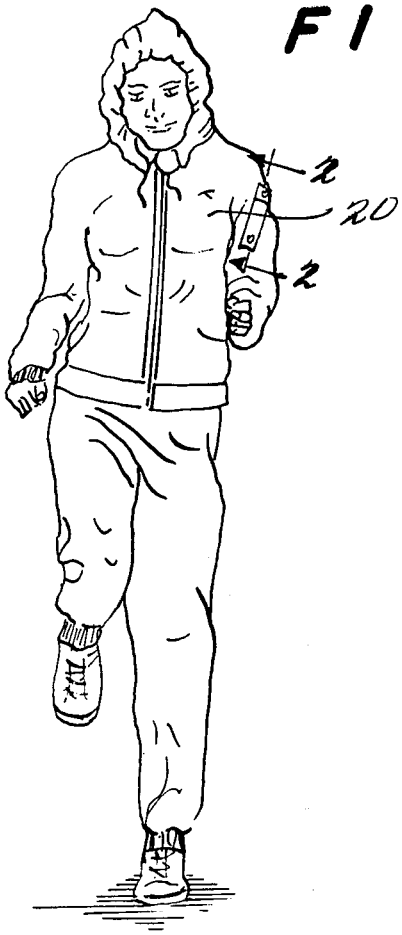
FIG. 2
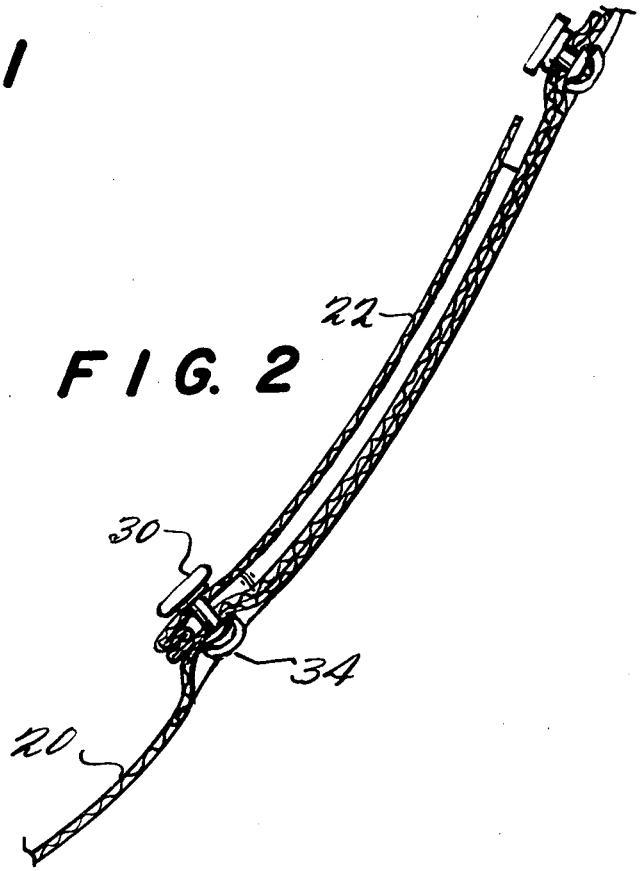
FIG. 3
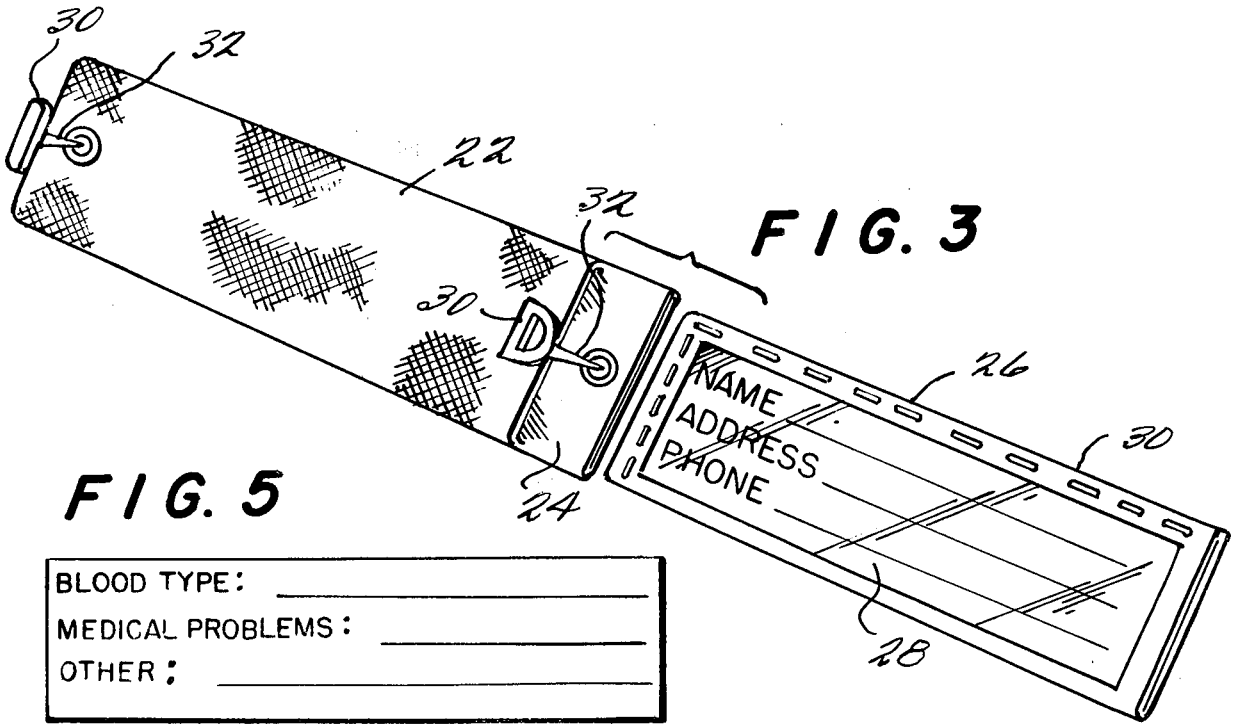
FIG. 5
BLOOD TYPE: _____
MEDICAL PROBLEMS: _____
OTHER: _____

JOGGER'S IDENTIFICATION TAG

BACKGROUND AND SUMMARY OF THE INVENTION

The invention relates to an identification tag for attachment to clothing during athletic activities, particularly during jogging.

During most athletic activities, other than those which take place in the nude, special clothing is worn which either has no provision for secure and easy carrying of the usual identification cards and the like normally carried or the possibilites for carrying such material are inconvenient. For example, most joggers prefer to carry as little weight as possible, and anything which is heavy enough to bounce in a pocket or the like is at the least irritating and can be damaging to body parts. During other activities, such as swimming, the conditions under which the activity takes place may result in damage to identification material which is difficult and expensive to replace. Another problem is that sweating during athletic activity may result in damage to any identification material which is carried. Another problem is that identification may not be readily found by those trying to assist an unconscious or dead athlete.

The present invention relates to a unique identification tag which can be easily and quickly attached at any desired location to any athletic clothing. The tag does not in any way interfere with the activity, and is almost unnoticeable. Moreover, the information which is contained within the tag is protected against damage by sweat or the like, and the tag can be laundered, either separately or attached to the athletic clothing. Preferably the tag is made prominent by the use of pins with the letters "I" and "D".

The tag of the present invention includes an elongated cloth pouch having an opening at at least one end for receiving an insert containing information which the person wishes to have with him in the event that medical attention is necessary because of his activities or for some other reason he needs to identify himself or be reminded of some information. Preferably, the insert includes a paper card in a plastic holder, or a laminated card can be used if the tag is to be used in a pool or the like. Any desired information can be placed by the user on the card and if that information changes, the card can simply be replaced. The pouch is preferably made of cloth so that it is flexible, does not interfere with the activities of the person wearing the tag, and can be laundered either separately or with the clothing. Any suitable structure for attaching the tag to the clothing can be utilized. Pins of the type which have a head at one end and cooperate with a locking structure on the other end can be used for that purpose.

Other objects and purposes of the invention will be clear from the following detailed description of the drawings.

BRIEF DESCRIPTION OF THE DRAWINGS

FIG. 1 shows an embodiment of the present invention in use on a jogger;

FIG. 2 shows a sectional view through the tag of the present invention in place on the clothing of a jogger;

FIG. 3 shows an exploded view of the invention of the present application with the insert removed;

FIG. 4 shows a view of the opposite side of the paper card on which medical information can be recorded.

DETAILED DESCRIPTION OF THE DRAWINGS

Reference is now made to FIGS. 1 and 2 which illustrate the unique tag 20 of the present invention, attached to clothing about the arm of a jogger. The tag is formed of a cloth pouch 22, having an open end 24, which can be best seen in FIG. 3. An insert 26, for example, made up of a paper card 28 and a plastic holder 30, open at one end for receiving the paper card, preferably comprise the insert. Any desired information can be placed on this card. In the illustrated embodiment, the identification of the jogger is placed on one side, and medical information as shown in FIG. 4 can be written on the other side.

Tag 20 is preferably held in place by pins. These pins include heads 30, a sharp portion 32 extending through eyes in pouch 22 and conventional locking structure 34 which attaches removably to the pin for holding tag 20 on the clothing. Locking structure 34 is of the type which can be removed by pinching to release from the sharp portions 32. As can be best seen in FIG. 3, the heads 30 are preferably formed as the letters "I" and "D" respectively to communicate the purpose of the identification tag.

Many changes and modifications in the above described embodiment of the invention can, of course, be carried out without departing from the scope thereof. Accordingly, that scope is intended to be limited only by the scope of the appended claims.

What is claimed is:

1. An identification tag holder for attachment to clothing during athletic activities comprising an elongated cloth pouch having an opening at at least one end for removably receiving an information bearing insert and first and second two-part removable securing means, one part having a pin extending through said pouch at respective opposite ends and a releasable second part for locking to said first part for removably attaching said tag to any desired place on said clothing, the area of the pouch between said securing means being unsecured to said article of clothing.

2. A tag as in claim 1, wherein said insert is a paper card in a plastic holder.

3. A tag as in claim 1, wherein each said one part includes a head formed as the letters I and D, respectively.

* * * * *